US008528509B2

(12) United States Patent
Cho et al.

(10) Patent No.: US 8,528,509 B2
(45) Date of Patent: Sep. 10, 2013

(54) VARIABLE VALVE LIFT APPARATUS

(75) Inventors: Hosung Cho, Hwaseong-si (KR); Jin Gyu Yang, Hwaseong-si (KR); Myung Rae Cho, Incheon (KR); Hong Wook Lee, Yongin (KR); Seong Hyuk Kang, Hwaseong (KR); Taewon Park, Hwaseong-Si (KR); Jinwoo Yang, Hwaseong-si (KR); Wootae Kim, Suwon (KR); Myungsik Choi, Seoul (KR); Eui Chul Choi, Seoul (KR); Sung Han Kang, Hwaseong-si (KR); Won Gyu Kim, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 546 days.

(21) Appl. No.: 12/844,596

(22) Filed: Jul. 27, 2010

(65) Prior Publication Data

US 2011/0132299 A1 Jun. 9, 2011

(30) Foreign Application Priority Data

Dec. 4, 2009 (KR) ..... 10-2009-0120129

(51) Int. Cl.
*F01L 1/34* (2006.01)

(52) U.S. Cl.
USPC ..... 123/90.16; 123/90.12; 123/90.44; 123/90.45; 123/90.48; 123/90.52

(58) Field of Classification Search
USPC ..... 123/90.48, 90.52, 90.55, 90.12, 90.16, 123/90.44, 90.45
See application file for complete search history.

(56) References Cited

U.S. PATENT DOCUMENTS 5,680,841 A * 10/1997 Hu ..... 123/322

FOREIGN PATENT DOCUMENTS

JP 7-34833 A 2/1995
JP 09004424 A * 1/1997

* cited by examiner

*Primary Examiner* — Ching Chang
(74) *Attorney, Agent, or Firm* — Morgan, Lewis & Bockius LLP

(57) ABSTRACT

A variable valve lift apparatus may include a variable valve lift housing, a master piston which is slidably disposed in the variable valve lift housing and contacts a cam, a slave piston which is slidably disposed in the variable valve lift housing, defines an oil chamber with the master piston therebetween, and opens a valve connected to the slave piston according to reciprocative motion of the master piston, and a lift control portion which supplies oil to the oil chamber or exhausts oil in the oil chamber selectively to control a relative distance between the master piston and the slave piston.

13 Claims, 8 Drawing Sheets

VARIABLE VALVE LIFT APPARATUS

CROSS-REFERENCE TO RELATED APPLICATION

The present application claims priority to Korean Patent Application No. 10-2009-0120129 filed in the Korean Intellectual Property Office on Dec. 4, 2009, the entire contents of which is incorporated herein for all purposes by this reference.

BACKGROUND OF THE INVENTION

1. Field of the Invention

The present invention relates to a variable valve lift apparatus. More particularly, the present invention relates to a variable valve lift apparatus that can control valve lift according to engine operation condition.

2. Description of Related Art

An internal combustion engine generates power by burning fuel in a combustion chamber in air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

An optimal operation of the intake valves and the exhaust valves depends on a rotation speed of the engine. That is, an optimal lift or optimal opening/closing timing of the valves depends on the rotation speed of the engine. In order to achieve such an optimal valve operation depending on the rotation speed of the engine, various researches, such as designing of a plurality of cam and a variable valve lift (VVL) that can change valve lift according to engine speed, have been undertaken.

A variable valve lift apparatus using hydraulic pressure has been widely researched, and the variable valve lift apparatus may control closing timing of a valve by controlling releasing timing of hydraulic pressure as well as control valve lift by using hydraulic pressure. However, when oil temperature of the variable valve lift apparatus is not within an oil operation temperature range, supplying or releasing of hydraulic pressure can be unstable.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a variable valve lift apparatus that may be operated regardless operated oil temperature.

In an aspect of the present invention, a variable valve lift apparatus may include a variable valve lift housing, a master piston which is slidably disposed in the variable valve lift housing and contacts a cam, a slave piston which is slidably disposed in the variable valve lift housing, defines an oil chamber with the master piston therebetween, and opens a valve connected to the slave piston according to reciprocative motion of the master piston, and a lift control portion which supplies oil to the oil chamber or exhausts oil in the oil chamber selectively to control a relative distance between the master piston and the slave piston.

The apparatus may further include a lost motion spring which is disposed within the oil chamber and elastically supports the master piston.

The apparatus may further include a guide portion which is protrudingly formed to the variable valve lift housing in the oil chamber and supports the lost motion spring therein.

The lift control portion may include a lift control valve which is slidably disposed to the variable valve lift housing and of which an oil hole is formed thereto for supplying oil to the oil chamber or exhausting oil from the oil chamber, and a lift control member for controlling position of the lift control valve to selectively open the oil chamber through the oil hole, wherein a control valve hole is formed to the variable valve lift housing and the lift control valve is slidably coupled to the control valve hole.

The lift control member may include a control shaft for controlling position of the lift control valve, and a control cam connected to the control shaft to change the position of the lift control valve in accordance with rotation of the control shaft, wherein the lift control valve comprises a contact portion which is protrudingly formed to contact the control cam.

The lift control valve may further include a slide portion extending from the contract portion and slidably disposed in the control valve hole, the oil hole being formed in the slide portion, wherein the lift control portion further comprises a control valve spring elastically supporting the slide portion of the lift control valve in the control valve hole.

The apparatus may further include a guide portion which is protrudingly formed to the valve lift housing in the oil chamber, a stepped portion which is formed to the slave piston to selectively contact the guide portion, and a bypass passage which is formed to the slave piston, wherein the oil in the oil chamber passes through the bypass passage when the slave piston reciprocates, wherein one end portion of the bypass passage is fluid-connected to the oil chamber and the other end portion thereof is selectively blocked by the guide portion in accordance with a reciprocative motion of the slave piston.

In another aspect of the present invention, the variable valve lift apparatus may include a plurality of variable valve lift housings, a plurality of master pistons which are slidably disposed to the variable valve lift housing and contact a cam respectively, a plurality of slave pistons which are slidably disposed to the variable valve lift housing, defines an oil chamber with the master piston therebetween, and open a valve connected to the slave piston respectively according to reciprocative motion of the master piston respectively, a plurality of lost motion springs which are disposed in the corresponding oil chamber to elastically support the respective master piston, a plurality of lift control valves which are slidably disposed to the respective variable valve lift housing and of which an oil hole is formed thereto for supplying oil to the corresponding oil chamber or exhausting the oil from the corresponding oil chamber respectively, one lift control member for controlling position of the lift control valve, and a plurality of control cams connected to the control shaft to change a position of the lift control valve respectively.

The apparatus may include a control valve spring elastically supporting the lift control valve respectively.

The apparatus may further include a guide portion which is protrudingly formed within each valve lift housing in the oil chamber, a stepped portion which is formed to each slave piston to selectively contact the guide portion, and a bypass passage which is formed to each slave piston, wherein the oil in the oil chamber passes through the bypass passage when the slave piston reciprocates, wherein one end portion of the bypass passage is fluid-connected to the oil chamber and the other end portion thereof is selectively blocked by the guide portion in accordance with a reciprocative motion of the slave piston.

As described above, the variable valve lift apparatus according to the exemplary embodiment of the present invention may be operated although oil temperature is within ranges that supplying and releasing of hydraulic pressure is not smooth.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
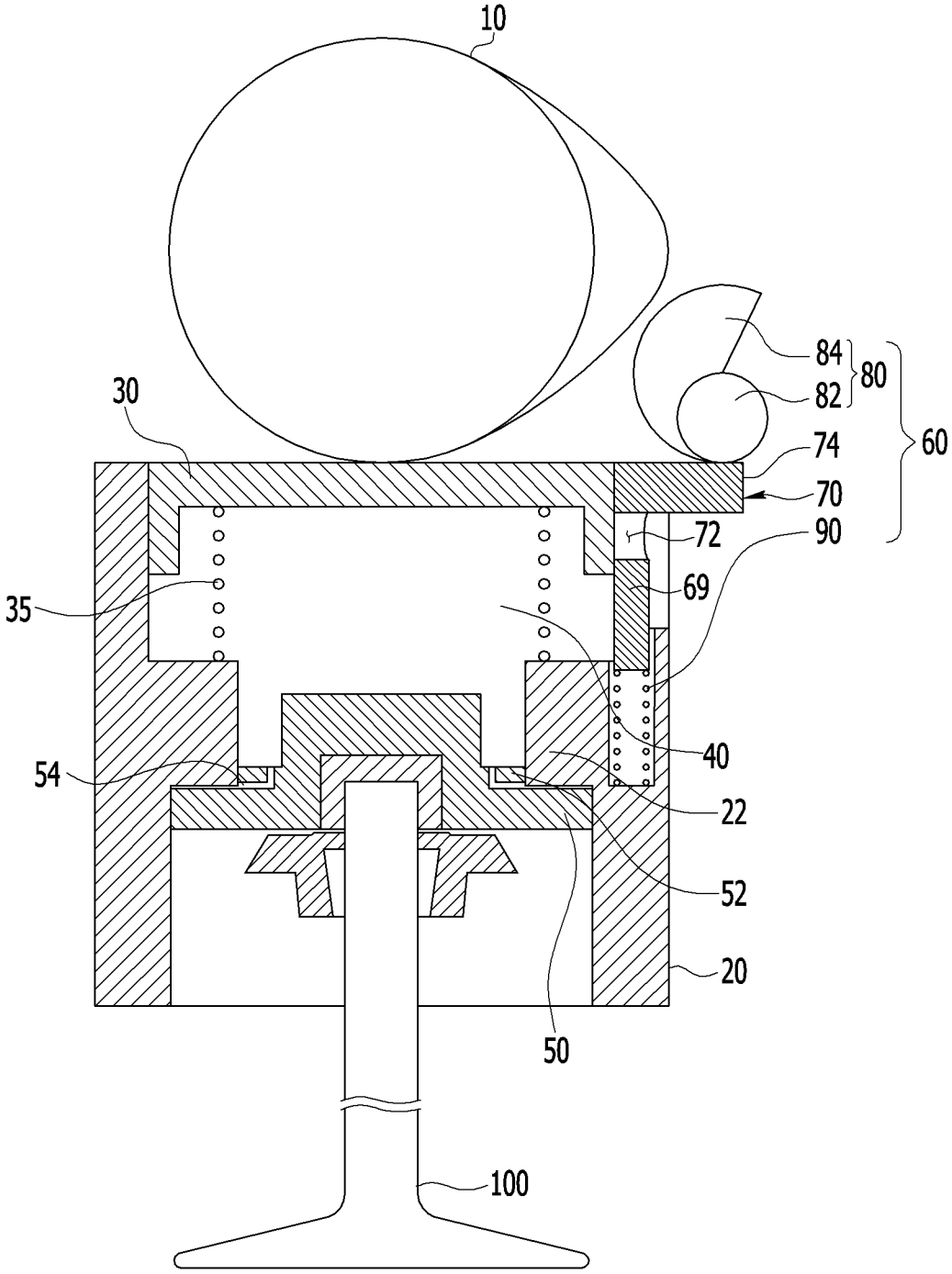
FIG. 1 is a drawing showing a valve closing in high lift mode of a variable valve lift apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

Figure 2:
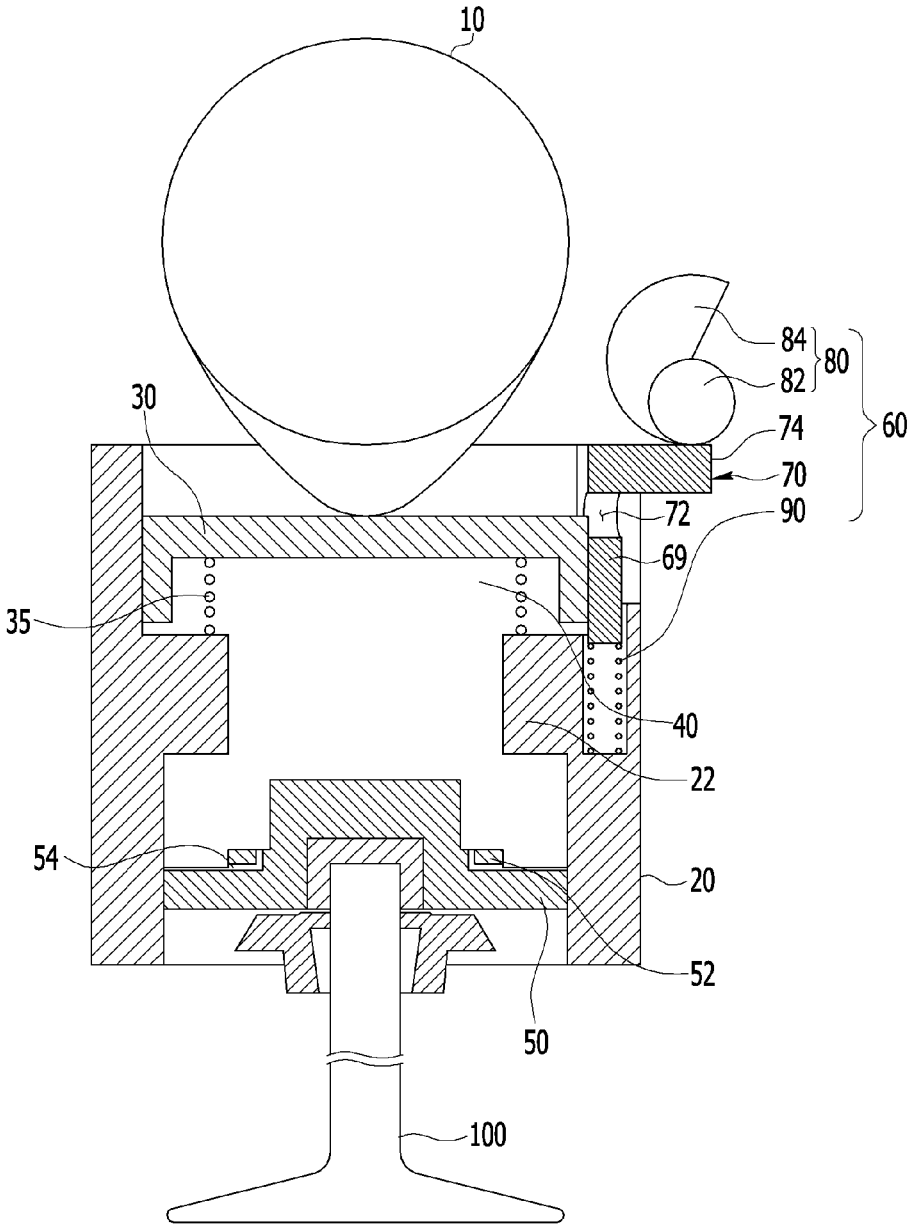
FIG. 2 is a drawing showing a valve opening in high lift mode of a variable valve lift apparatus according to an exemplary embodiment of the present invention.

FIG. 1 and FIG. 2 are drawings showing a valve closing and opening respectively in high lift mode of a variable valve lift apparatus according to an exemplary embodiment of the present invention and FIG. 5 to FIG. 9 are drawings showing elements of the variable valve lift apparatus according to an exemplary embodiment of the present invention.

Referring to FIG. 1, FIG. 2 and FIG. 5 to FIG. 9, a variable valve lift apparatus according to an exemplary embodiment of the present invention includes a variable valve lift housing 20, a master piston 30 which is slidably disposed to the variable valve lift housing 20 and contacts a cam 10, a slave piston 50 which is slidably disposed to the variable valve lift housing 20, defines an oil chamber 40 with the master piston 30, and opens a valve 100 according to reciprocative motion of the master piston 30 and a lift control portion 60 which supplies oil to the oil chamber 40 and exhausts the oil in the oil chamber 40.

The variable valve lift housing 20 may be mounted to an engine, cylinder head, or cam carrier (not shown) and so on, or the variable valve lift housing 20 may be integrally formed to an engine, cylinder head, or cam carrier (not shown) and so on.

The apparatus further includes a lost motion spring 35 which is disposed within the oil chamber 40 and elastically supports the master piston 30.

The lift control portion 60 includes a lift control valve 70 which is slidably disposed to the variable valve lift housing 20 and of which an oil hole 72 is formed thereto for supplying oil to the oil chamber 40 and exhausting the oil from the oil chamber 40 and a lift control member 80 for controlling position of the lift control valve 70, wherein a control valve hole 24 is formed to the variable valve lift housing 20 and the lift control valve 70 is slidably disposed to the control valve hole 24.

The lift control member 80 includes a control shaft 82 for controlling position of the lift control valve 70 and a control cam 84 connected to the control shaft 82 to contact the lift control valve 84.

The lift control valve 70 further includes a slide portion 69 and a contact portion 74 which is formed protrudingly from the slide portion 69 to contact the control cam 84. The slide portion 69 of the lift control valve 70 is slidably disposed to the control valve hole 24.

The lift control portion 60 further includes a control valve spring 90 elastically supporting the slide portion 69 of the lift control valve 70 in the control valve hole 24.

The apparatus according to exemplary embodiment of the present invention further includes a guide portion 22 which is protrudingly formed within the valve lift housing 20, a stepped portion 52 which is formed to the slave piston 50 to selectively contact the guide portion 22 and a bypass passage 54 which is formed to the slave piston 50, wherein the oil in the oil chamber 40 may pass through the bypass passage 54 when the slave piston 50 reciprocates.

Figure 3:
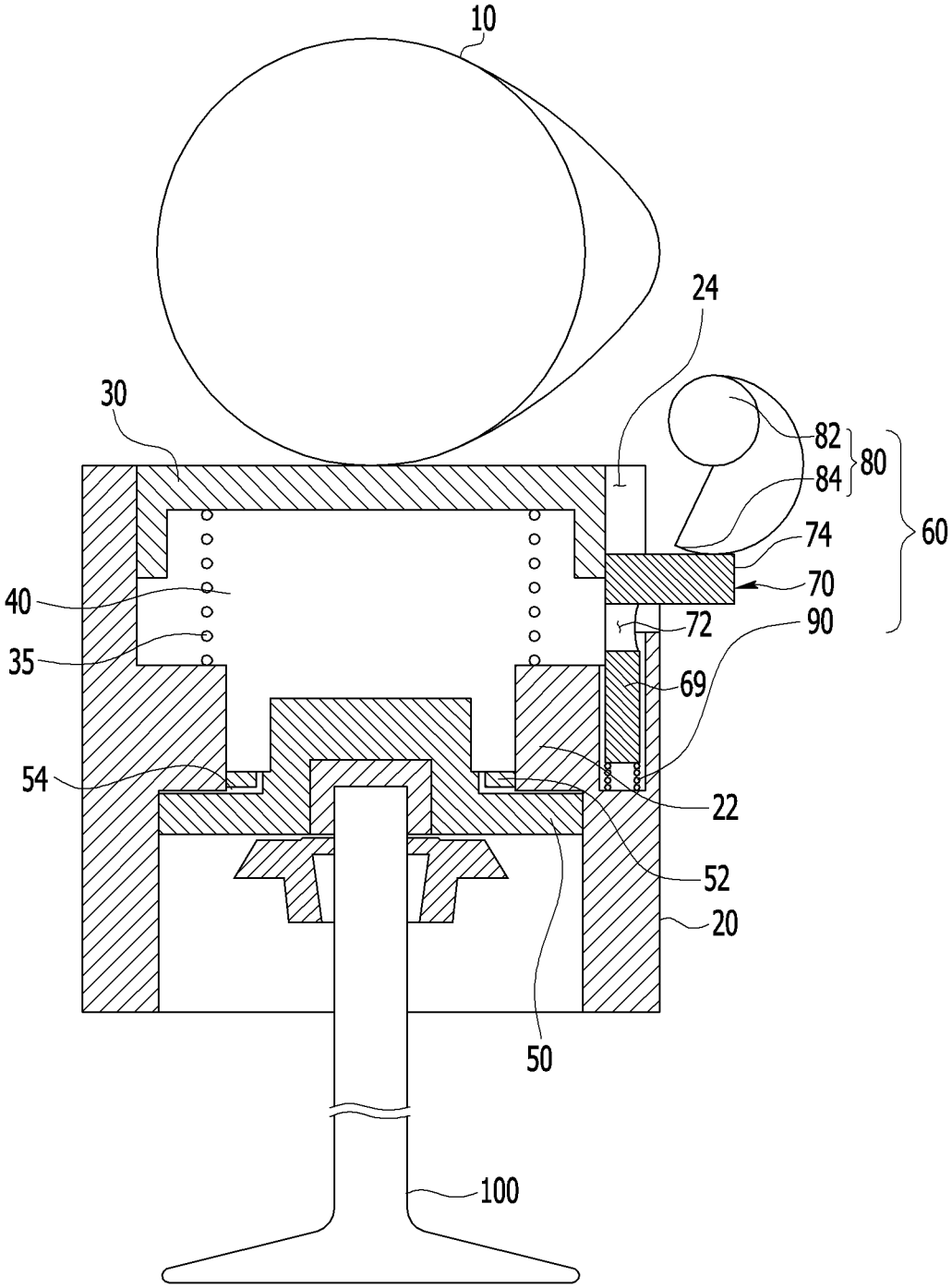
FIG. 3 is a drawing showing a valve closing in low lift mode of a variable valve lift apparatus according to an exemplary embodiment of the present invention.
Figure 4:
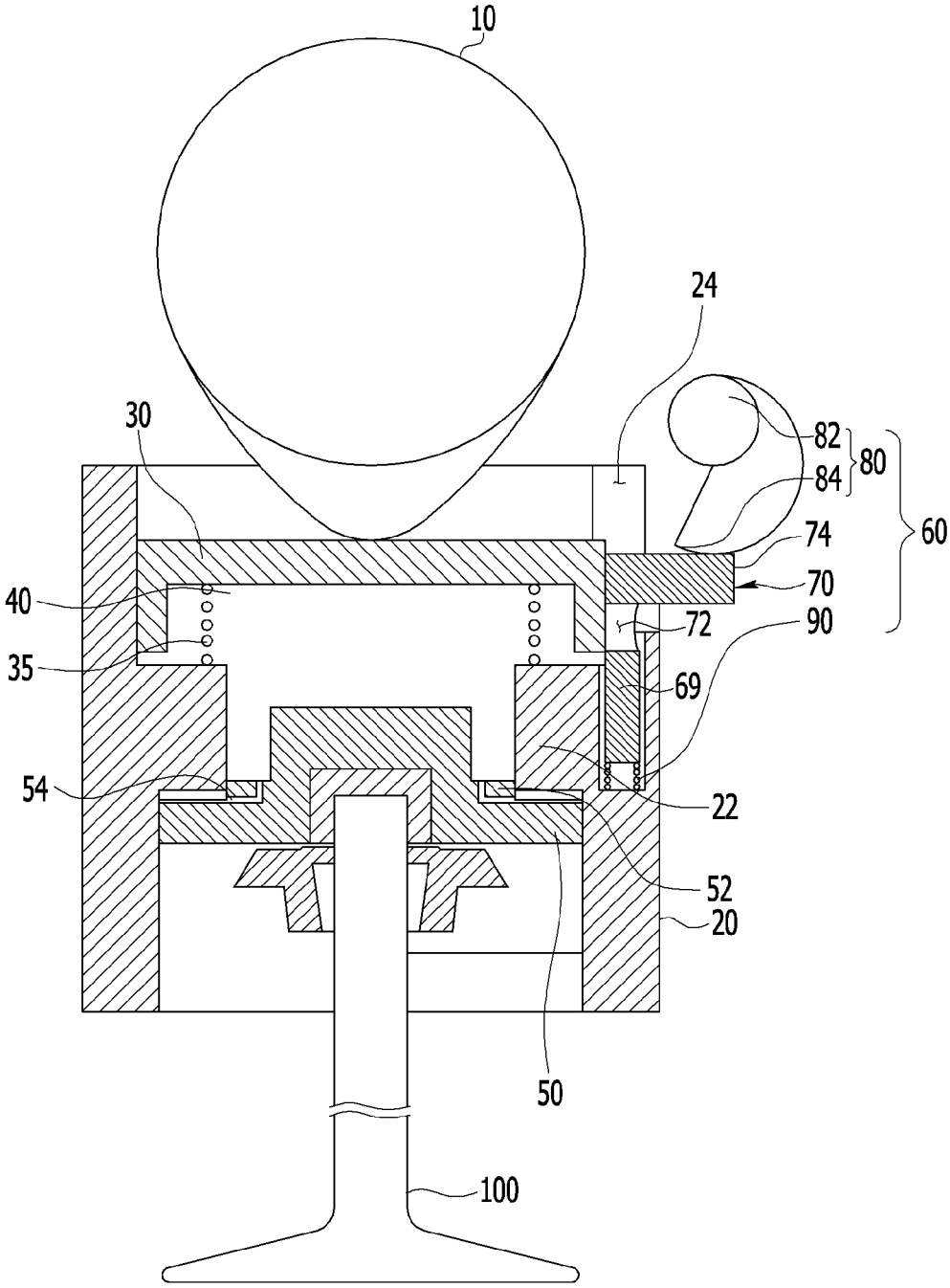
FIG. 4 is a drawing showing a valve opening in high low mode of a variable valve lift apparatus according to an exemplary embodiment of the present invention.
Figure 5:
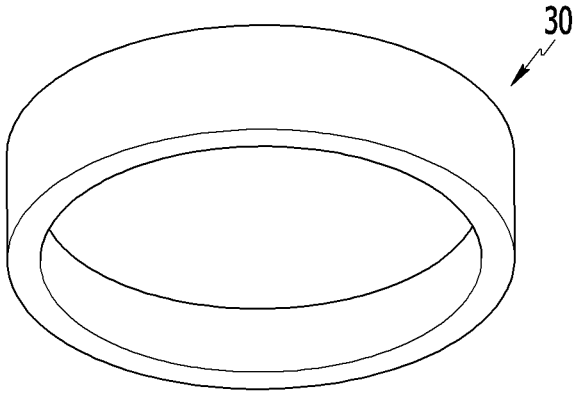
FIG. 5 to FIG. 9 are drawings showing elements of the variable valve lift apparatus according to an exemplary embodiment of the present invention.
Figure 6:
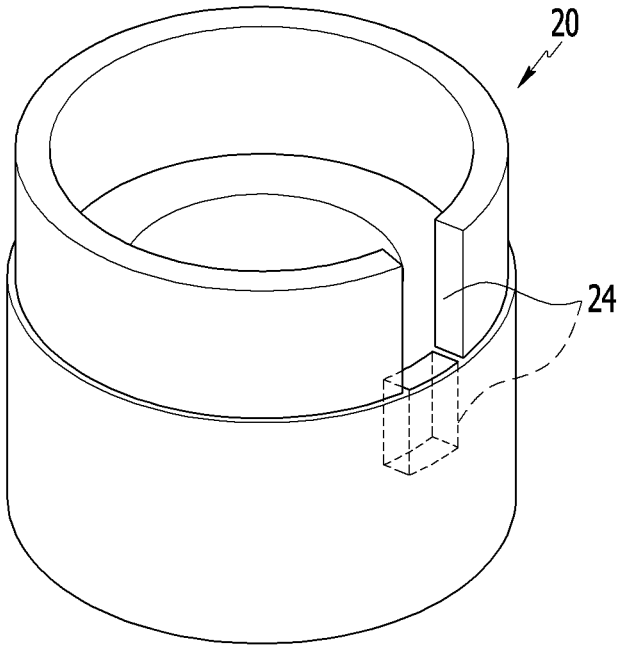
Figure 7:
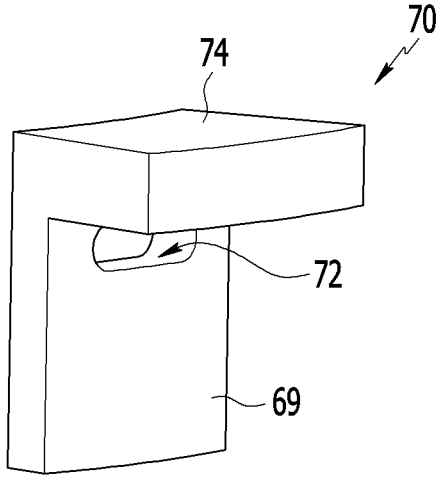
Figure 8:
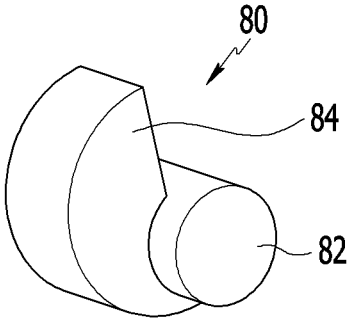
Figure 9:
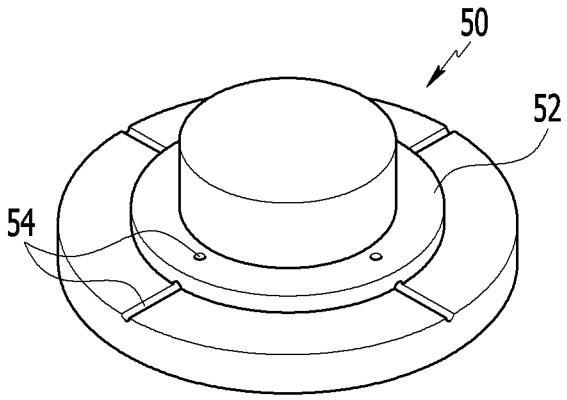

FIG. 3 and FIG. 4 are drawings showing a valve closing and opening respectively in low lift mode of a variable valve lift apparatus according to an exemplary embodiment of the present invention.

Hereinafter, operations in high lift mode and low lift mode of the variable valve lift apparatus according to the exemplary embodiment of the present invention will be described referring to FIG. 1 to FIG. 4.

As shown FIG. 1 and in FIG. 2, in the high lift mode of the variable valve lift apparatus according to the exemplary embodiment of the present invention, the control cam 84 does not push the contact portion 74 and the oil hole 72 does not communicate with the oil chamber 40 although the cam 10 rotates to push for the master piston 30 to reciprocate.

And thus, the reciprocative motion of the master piston 30 induces reciprocative motion of the slave piston 50 through the oil in the oil chamber 40 and the valve 100 is opened.

In this moment, the oil passes through the bypass passage 54 when the stepped portion 52 is separated from the guide portion 22 or the stepped portion 52 contacts the guide portion 22 so that opening/closing impact of the valve 100 may be reduced.

In the lift mode, as shown in FIG. 3 and, the control shaft 82 rotates for the control cam 84 to push the contact portion 74.

In this case, the oil hole 72 communicates with the oil chamber 40 and the oil in the oil chamber 40 may be partially released. So relative distance between the master piston 30 and the slave piston 50 is changed according to released amount of the oil in the oil chamber 40 and lift of the valve 100 is changed.

As described above, opening/closing impact of the valve 100 may be reduced due to the stepped portion 52 and the bypass passage 54.

When the low lift mode is changed to the high lift mode, the control cam 84 rotates the lift control valve 70 returns to the original position and oil is supplied to the oil chamber 40 through the oil hole 72.

Figure 10:
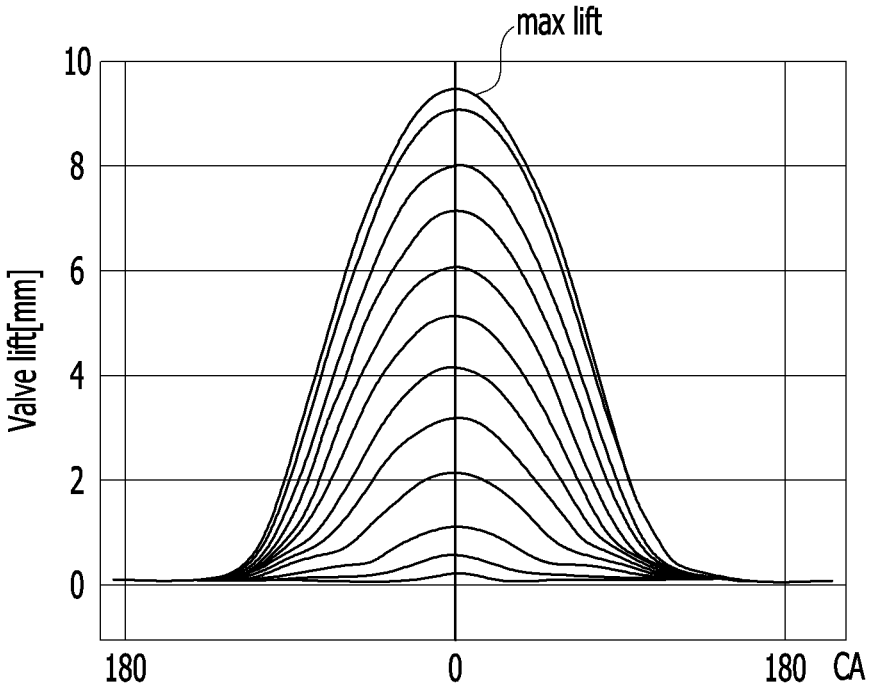
FIG. 10 is a graph showing valve lift profile of the variable valve lift apparatus according to an exemplary embodiment of the present invention.

FIG. 10 is a graph showing valve lift profile of the variable valve lift apparatus according to an exemplary embodiment of the present invention.

While the high lift mode and the low lift mode of the variable valve lift apparatus according to the exemplary embodiment of the present invention are describe, it is to be understood that the present invention is not limited to the disclosed embodiments. On the contrary, it is intended to cover various modified modes, for example continuous variable lift mode.

As shown in FIG. 10, the control cam 84 may be controlled to realize variable valve lift profile.

In this case, controlling rotation angle of the control cam 84 and supplying/releasing of oil through the oil hole 72 are obvious to the person skilled in the art, so a detailed description thereof will be omitted.

In addition, the variable valve lift apparatus according to the exemplary embodiment of the present invention may be pluralities and disposed to each cylinder with one control shaft 82 and a plurality of control cam 84 which contact each lift control valve 70 respectively.

That is, the variable valve lift apparatuses according to the exemplary embodiment of the present invention, which are provided to each cylinder, may be controlled by one control shaft 82 to output various valve profiles so that oil supplying lines can be simplified, control can be simplified, and manufacturing cost may be reduced.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable valve lift apparatus comprising:

a variable valve lift housing;

a master piston which is slidably disposed in the variable valve lift housing and contacts a cam;

a slave piston which is slidably disposed in the variable valve lift housing, defines an oil chamber with the master piston therebetween, and opens a valve connected to the slave piston according to reciprocative motion of the master piston; and a lift control portion which supplies oil to the oil chamber or exhausts oil in the oil chamber selectively to control a relative distance between the master piston and the slave piston, wherein the lift control portion comprises:

a lift control valve which is slidably disposed to the variable valve lift housing and of which an oil hole is formed thereto for supplying oil to the oil chamber or exhausting oil from the oil chamber; and a lift control member for controlling position of the lift control valve to selectively open the oil chamber through the oil hole;

wherein a control valve hole is formed to the variable valve lift housing and the lift control valve is slidably coupled to the control valve hole.

2. The apparatus of claim 1, further comprising a lost motion spring which is disposed within the oil chamber and elastically supports the master piston.

3. The apparatus of claim 2, further comprising a guide portion which is protrudingly formed to the variable valve lift housing in the oil chamber and supports the lost motion spring therein.

4. The apparatus of claim 1, wherein the lift control member comprises:

a control shaft for controlling position of the lift control valve; and a control cam connected to the control shaft to change the position of the lift control valve in accordance with rotation of the control shaft.

5. The apparatus of claim 4, wherein the lift control valve comprises a contact portion which is protrudingly formed to contact the control cam.

6. The apparatus of claim 5, wherein the lift control valve further comprises a slide portion extending from the contract portion and slidably disposed in the control valve hole, the oil hole being formed in the slide portion.

7. The apparatus of claim 6, wherein the lift control portion further comprises a control valve spring elastically supporting the slide portion of the lift control valve in the control valve hole.

8. The apparatus of claim 1, further comprising:

a guide portion which is protrudingly formed to the valve lift housing in the oil chamber;

a stepped portion which is formed to the slave piston to selectively contact the guide portion; and a bypass passage which is formed to the slave piston, wherein the oil in the oil chamber passes through the bypass passage when the slave piston reciprocates.

9. The apparatus of claim 8, wherein one end portion of the bypass passage is fluid-connected to the oil chamber and the other end portion thereof is selectively blocked by the guide portion in accordance with a reciprocative motion of the slave piston.

10. A variable valve lift apparatus comprising:

a plurality of variable valve lift housings;

a plurality of master pistons which are slidably disposed to the variable valve lift housing and contact a cam respectively;

a plurality of slave pistons which are slidably disposed to the variable valve lift housing, defines an oil chamber with the master piston therebetween, and open a valve connected to the slave piston respectively according to reciprocative motion of the master piston respectively;

a plurality of lost motion springs which are disposed in the corresponding oil chamber to elastically support the respective master piston;

a plurality of lift control valves which are slidably disposed to the respective variable valve lift housing and of which an oil hole is formed thereto for supplying oil to the corresponding oil chamber or exhausting the oil from the corresponding oil chamber respectively;

one lift control member for controlling position of the lift control valve valves; and a plurality of control cams connected to a control shaft to change a position of the lift control valve respectively.

11. The apparatus of claim 10, further comprising a control valve spring elastically supporting the lift control valve respectively.

12. The apparatus of claim 10, further comprising:

a guide portion which is protrudingly formed within each valve lift housing in the oil chamber;

a stepped portion which is formed to each slave piston to selectively contact the guide portion; and a bypass passage which is formed to each slave piston, wherein the oil in the oil chamber passes through the bypass passage when the slave piston reciprocates.

13. The apparatus of claim 12, wherein one end portion of the bypass passage is fluid-connected to the oil chamber and the other end portion thereof is selectively blocked by the guide portion in accordance with a reciprocative motion of the slave piston.

* * * * *